US008587480B2

(12) United States Patent
Kim et al.

(10) Patent No.: US 8,587,480 B2
(45) Date of Patent: Nov. 19, 2013

(54) PATCH ANTENNA AND MANUFACTURING METHOD THEREOF

(75) Inventors: Jongsoo Kim, Gyeonggi-do (KR); Inyoung Lee, Gyeonggi-do (KR); Sanghyeok Cho, Incheon (KR)

(73) Assignee: Amotech Co., Ltd., Gyeonggi (KR)

( * ) Notice: Subject to any disclaimer, the term of this patent is extended or adjusted under 35 U.S.C. 154(b) by 454 days.

(21) Appl. No.: 12/440,842

(22) PCT Filed: Sep. 10, 2007

(86) PCT No.: PCT/KR2007/004360

§ 371 (c)(1), (2), (4) Date: Aug. 31, 2009

(87) PCT Pub. No.: WO2008/032960

PCT Pub. Date: Mar. 20, 2008

(65) Prior Publication Data

US 2010/0039345 A1 Feb. 18, 2010

(30) Foreign Application Priority Data

Sep. 11, 2006 (KR) ..... 10-2006-0087628

(51) Int. Cl.

| | |
|---|---|
| ***H01Q 1/38*** | (2006.01) |
| ***H01Q 5/00*** | (2006.01) |
| ***H01Q 9/04*** | (2006.01) |
| ***H01Q 15/02*** | (2006.01) |

(52) U.S. Cl.

USPC ..... 343/700 MS; 343/909; 343/846

(58) Field of Classification Search

USPC ..... 343/700 MS, 846, 909

See application file for complete search history.

(56) References Cited

U.S. PATENT DOCUMENTS

| | | | | |
|---|---|---|---|---|
| 6,181,281 | B1 | 1/2001 | Desclos et al. | |
| 6,211,824 | B1 * | 4/2001 | Holden et al. | 343/700 MS |
| 6,433,756 | B1 | 8/2002 | Sievenpiper et al. | |
| 6,573,867 | B1 | 6/2003 | Desclos et al. | |
| 6,859,175 | B2 * | 2/2005 | Desclos et al. | 343/700 MS |
| 6,888,510 | B2 * | 5/2005 | Jo et al. | 343/797 |
| 6,919,862 | B2 * | 7/2005 | Hacker et al. | 343/909 |
| 7,061,431 | B1 * | 6/2006 | Tonn | 343/700 MS |
| 8,159,413 | B2 * | 4/2012 | Park et al. | 343/909 |
| 2002/0008665 | A1 * | 1/2002 | Takenoshita | 343/700 MS |
| 2003/0011522 | A1 | 1/2003 | McKinzie et al. | |
| 2004/0032368 | A1 * | 2/2004 | Spittler | 343/700 MS |
| 2004/0066340 | A1 * | 4/2004 | Hacker et al. | 343/700 MS |
| 2004/0104848 | A1 | 6/2004 | Desclos et al. | |
| 2004/0201523 | A1 * | 10/2004 | Yuanzhu | 343/700 MS |
| 2005/0116875 | A1 | 6/2005 | Yuanzhu et al. | |

FOREIGN PATENT DOCUMENTS

| | | |
|---|---|---|
| FR | 2 552 938 A1 | 4/1985 |
| JP | 04-027609 | 3/1992 |
| JP | 06-037533 | 2/1994 |

(Continued)

*Primary Examiner* — Douglas W Owens
*Assistant Examiner* — Jennifer F Hu
(74) *Attorney, Agent, or Firm* — Dickstein Shapiro LLP

(57) ABSTRACT

The present invention provides a patch antenna having a dielectric layer that is composed of one dielectric film, has one or more holes formed therein by punching, and is provided between a patch and a ground plate, and a method of manufacturing the patch antenna. Since the patch antenna uses a dielectric material having a low relative dielectric constant (a low dielectric material), it is possible to reduce the size of a patch antenna and improve productivity.

5 Claims, 12 Drawing Sheets

(56) References Cited

FOREIGN PATENT DOCUMENTS

| | | |
|---|---|---|
| JP | 10-145133 | 5/1998 |
| JP | 2002-271133 | 9/2002 |
| JP | 2005-124056 | 5/2005 |

* cited by examiner (a)

(b)

(a)

(b)

(a)

(b)

(a)

(b)

(a)

(b)

PATCH ANTENNA AND MANUFACTURING METHOD THEREOF

CROSS REFERENCE TO RELATED APPLICATION

This U.S. patent is a national stage entry of the corresponding PCT Application PCT/KR2007/004360, filed on Sep. 10, 2007, which claims priority to Korean Application No. 10-2006-0087628, filed Sep. 11, 2006.

TECHNICAL FIELD

The present invention relates to a patch antenna, and more particularly, to a patch antenna that uses a dielectric material having a low dielectric constant to reduce the size thereof.

BACKGROUND ART

With the development of a wireless communication technique, information communication terminals, such as mobile phones, PDAs, and GPS receivers, have become popular. Patch antennas having a small size, a small thickness, and light weight are generally used for the information communication terminals.

FIG. 1 is a diagram illustrating an example of a patch antenna according to the related art. Since the patch antenna shown in FIG. 1 includes a ceramic dielectric substrate, it is also called a ceramic patch antenna. The patch antenna shown in FIG. 1 includes a dielectric substrate 10 having a predetermined thickness, a planar patch that serves as an antenna and is provided on one surface (upper surface) of the dielectric substrate 10, and a ground plate 14 that is provided on the other surface (lower surface) of the dielectric substrate 10.

The patch 12 can be formed in various shapes, such as a rectangle, a circle, an ellipse, a triangle, and a ring, in plan view. The patch 12 is generally formed in a rectangular shape or a circular shape in plan view.

Power can be supplied to the patch 12 through a micro-strip line or a probe. When power is supplied through the micro-strip line, antenna characteristics and input impedance depend on the position where power is supplied. Therefore, matching between the feeding line and the patch is important, but the method of supplying power through the micro-strip line has an advantage in that it is easy to manufacture the antenna. In the method of supplying power using the probe, it is possible to supply power to a position where the feeding line and the patch are well matched with each other, and thus an additional matching circuit is not needed.

In general, the size of the patch antenna is proportional to the wavelength of a design frequency. When the same frequency is used, a dielectric substrate having a high relative dielectric constant should be used to reduce the size of the patch antenna.

However, when a dielectric material having a high relative dielectric constant is used, the radiation characteristic of the antenna is lowered, resulting in a low gain.

When the relative dielectric constant of a dielectric material increases, manufacturing costs increase, and yield is rapidly lowered. Therefore, there are limitations in using a dielectric material having a high relative dielectric constant to reduce the size of an antenna.

In order to solve these problems, Korean Patent No. 10-0562788 discloses a patch antenna.

The patch antenna disclosed in Korean Patent No. 10-0562788 includes: a patch that includes one or more corners having a 'U' shape or a 'W' shape; a ground plate that is spaced from the patch by a predetermined gap therebetween and includes one or more corners having a 'U' shape so as to cover the corners of the patch; and a dielectric layer that is provided between the ground plate and the patch. The patch includes a patch body having a predetermined shape in plan view and vertical and horizontal portions that are formed in a 'U' shape or a 'W' shape by bending the corners of the patch body two times. The ground plate includes a plate body having a predetermined shape in plan view, and vertical and horizontal portions that extend from the edge of the plate body and are bent. The horizontal portion of the ground plate is opposite to the plate body with the patch interposed therebetween.

In the folded patch antenna disclosed in Korean Patent No. 10-0562788, when the dielectric layer is used as an air layer, it is possible to simplify a manufacturing process. However, when a dielectric material having a high relative dielectric constant is used instead of the air layer in order to reduce the size of an antenna, the manufacturing process becomes complicated.

In order to solve this problem, a patch antenna (Korean Patent No. 10-0562786) using a dielectric layer laminating process has been proposed.

The patch antenna disclosed in Korean Patent No. 10-0562786 includes: a ground plate; a patch that is spaced from the ground plate by a predetermined gap therebetween; a dielectric layer that is provided between the ground plate and the patch; and a plurality of protrusions that have a predetermined height and are arranged at predetermined intervals on the patch and/or the ground plate.

In the patch antenna disclosed in Korean Patent No. 10-0562786, as shown in FIG. 2, thin dielectric films 50 are laminated. A patch 20 is printed (coated) on the uppermost dielectric film 50. A plurality of holes 54 are formed in the dielectric film 50 having the patch 20 printed thereon and the other dielectric films 50 in a predetermined pattern, and the dielectric film 50 having a predetermined thickness is laminated thereon. Then, a conductive material is filled into the holes 54, and is heated so as to be melted, thereby forming a plurality of protrusions. In FIG. 2, reference numeral 22 denotes a ground plate, reference numeral 56 denotes a hole for supplying power.

DISCLOSURE OF INVENTION

Technical Problem

In the patch antenna shown in FIG. 2, a plurality of dielectric films 50 are prepared, the holes 54 are formed in each of the dielectric films 50, and the dielectric films 50 are laminated with a desired thickness. This structure has a problem in that a manufacturing process becomes more complicated than a process of manufacturing a patch antenna according to the related art.

In particular, in a general patch antenna, in order to obtain a predetermined gain characteristic, the thickness of the dielectric layer provided between the patch and the ground plate should be larger than a predetermined value. However, in the patch antenna formed by laminating the dielectric films shown in FIG. 2, a process of adjusting the total thickness of the laminated dielectric films 50 to a desired thickness and the protrusion forming process are needed. As a result, expensive manufacturing apparatuses are needed to perform these processes. Therefore, manufacturing costs increase, which makes it difficult to meet demands for inexpensive PDAs and GPS antennas for vehicles.

The invention is designed to solve these problems, and an object of the invention is to provide a patch antenna that uses a dielectric material having a low relative dielectric constant to reduce the size thereof and to improve productivity and a method of manufacturing a patch antenna.

Technical Solution

In order to achieve the object, according to an embodiment of the invention, a patch antenna includes: a patch that is connected to a feeding line; a ground plate that is spaced from the patch by a predetermined gap; and a dielectric layer that has one or more holes with a predetermined depth formed therein and is provided between the patch and the ground plate.

A conductive material may be applied onto the inner surface of each of the holes formed in the dielectric layer.

Upper parts of the holes may come into contact with the edge of a lower surface of the patch.

According to another embodiment of the invention, a patch antenna includes: a patch that is connected to a feeding line; a ground plate that is spaced from the patch by a predetermined gap; and a dielectric layer that is provided between the patch and the ground plate. In the patch antenna, one or more holes with a predetermined depth is formed in the patch and the dielectric layer and conductive materials are inserted into the holes.

According to still another embodiment of the invention, there is provided a method of manufacturing a patch antenna. The method includes: preparing a dielectric layer having a predetermined thickness, the dielectric layer being composed of one dielectric film; forming one or more holes in the dielectric layer by using a puncher; applying a conductive material onto the inner surface of each of the holes; and providing the patch on an upper surface of the dielectric layer having the holes formed therein and providing the ground plate on a lower surface of the dielectric layer.

When the patch is provided on the upper surface of the dielectric layer having the holes formed therein, Upper parts of the holes may come into contact with the edge of a lower surface of the patch.

According to yet another embodiment of the invention, there is provided a method of manufacturing a patch antenna. The method includes: preparing a dielectric layer having a predetermined thickness, the dielectric layer being composed of one dielectric film; providing the patch on an upper surface of the dielectric layer; forming one or more holes in a laminated structure of the patch and the dielectric layer by using a puncher; inserting conductive materials into the holes; and providing a ground plate on a lower surface of the dielectric layer.

According to still yet another embodiment of the invention, a patch antenna includes: an upper patch; a lower patch that is divided into a plurality of patch groups each having a plurality of patch pieces that are separated by a plurality of slots; a first dielectric layer that is provided between the upper patch and the lower patch; and a second dielectric layer that is provided on a lower surface of the lower patch. In the patch antenna, the upper patch and the lower patch are electrically connected to each other by holes passing through the first dielectric layer.

The patch antenna according to the above-mentioned aspect may further include: a ground plate that is provided on a lower surface of the second dielectric layer.

The holes may be formed at the edge of the first dielectric layer so as to pass through the first dielectric layer.

Conductive materials may be inserted into the holes.

A conductive material may be applied onto the inner surface of each of the holes.

The plurality of patch groups of the lower patch may be formed such that the patch groups opposite to each other are aligned symmetrically.

The thickness of the first dielectric layer may be larger than that of the second dielectric layer.

The second dielectric layer may have a higher relative dielectric constant than that of the first dielectric layer.

Advantageous Effects

As described above, the invention can obtain the following effects.

According to a first embodiment, an antenna includes a dielectric layer that is composed of one thin film and has a plurality of holes formed therein by punching. Therefore, it is easier to manufacture an antenna than to manufacture it by the dielectric film laminating method according to the related art, and to manufacture an inexpensive antenna in large quantities.

According to a second embodiment, holes are formed in a patch and a dielectric layer having a low dielectric constant, and metal pins are inserted into the holes to connect the dielectric layer and the patch, without coating the inner surfaces of the holes with a conductive material. Therefore, it is possible to easily manufacture an inexpensive and small patch antenna in large quantities.

According to a third embodiment, the patch is divided into an upper patch and a lower patch each having a plurality of holes formed therein, two dielectric layers having a low dielectric constant are used, and slots are formed in the lower patch. Therefore, it is possible to obtain a patch antenna having a higher degree of radiation efficiency and a higher gain characteristic than the existing folded patch antenna. In addition, it is possible to obtain a patch antenna having a desired resonance frequency with a smaller size than that of the existing folded patch antenna.

According to a fourth embodiment, it is possible to provide a small patch antenna that is not provided with the ground plate, but can obtain a desired resonance frequency. As a result, it is possible to manufacture a patch antenna in large quantities at a low manufacturing cost.

According to the first to fourth embodiments, it is possible to achieve an antenna having the same resonance frequency as the existing high dielectric antenna even when a dielectric material having a low dielectric constant is used.

According to the first to fourth embodiments, it is possible to change the resonance frequency and reduce the size of an antenna by using a low dielectric constant material and providing holes and slots, unlike a patch antenna using a high dielectric material according to the related art. As a result, it is possible to manufacture an antenna having a small size and a desired resonance frequency.

REFERENCE NUMERALS

Figure 1:
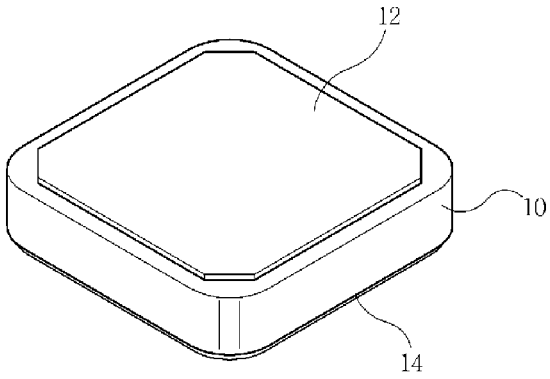
FIG. 1 is a perspective view illustrating the structure of an antenna according to the related art.
Figure 2:
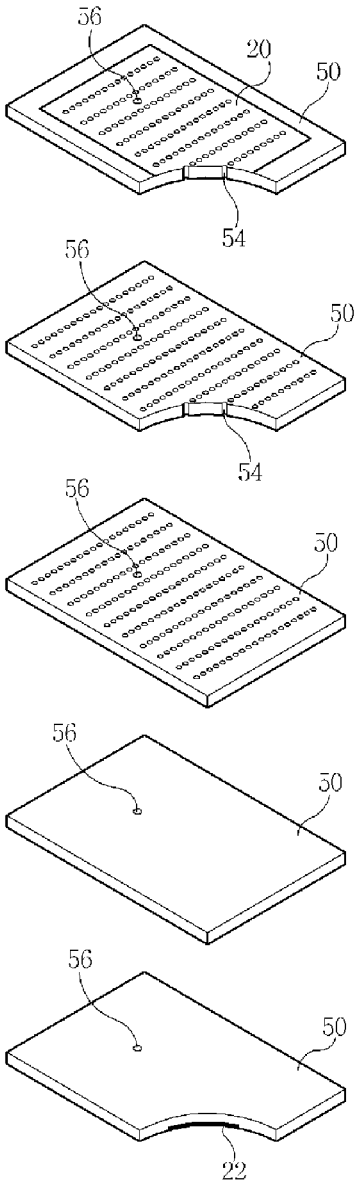
FIG. 2 is an exploded perspective view illustrating an iris patch antenna having dielectric films.

70: patch
80: ground plate
90: dielectric layer
92, 94, 95, 132, 232: hole
100, 160, 260: metal pin
110, 210: upper patch
112, 212: through hole
120, 220: lower patch
121, 221: patch piece
122, 222: slot
130, 230: first dielectric layer
140, 240: second dielectric layer
150: ground plate

BEST MODE FOR CARRYING OUT THE INVENTION

Hereinafter, patch antennas according to embodiments of the invention will be described below with reference to the accompanying drawings.

First Embodiment

Figure 3:
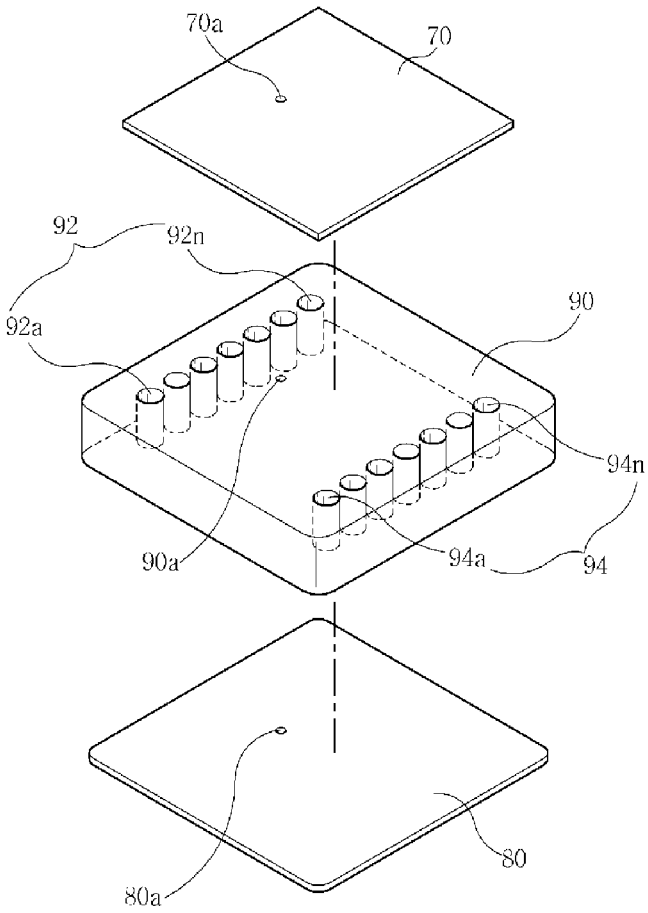
FIG. 3 is an exploded perspective view illustrating a patch antenna according to a first embodiment of the invention.
Figure 4:
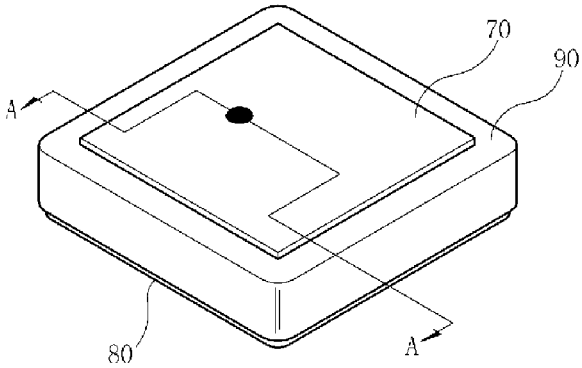
FIG. 4 is a perspective view illustrating the assembled patch antenna shown in FIG. 3.
Figure 5:
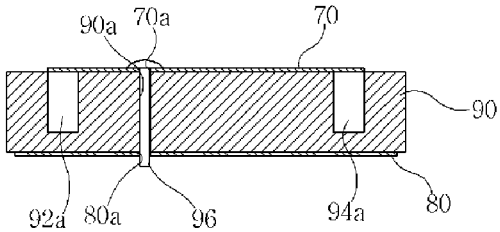
FIG. 5 is a cross-sectional view taken along the line A-A of FIG. 4.
Figure 6:
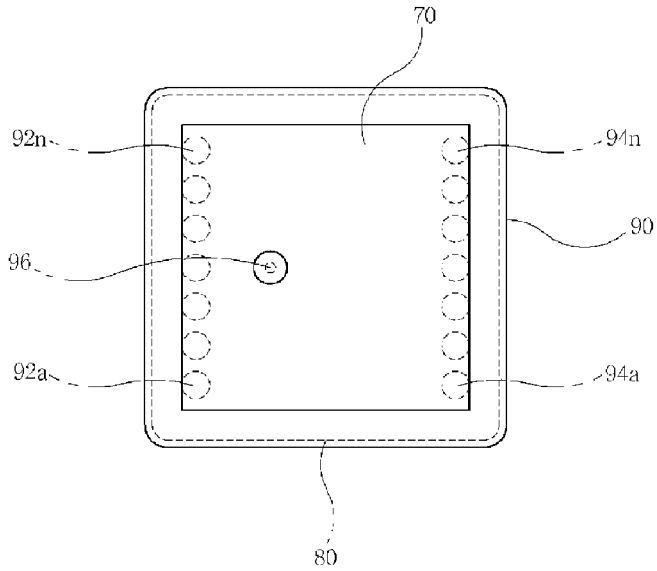
FIG. 6 is a plan view of FIG. 5.

FIG. 3 is an exploded perspective view illustrating a patch antenna according to a first embodiment of the invention. FIG. 4 is a perspective view illustrating the assembled patch antenna shown in FIG. 3. FIG. 5 is a cross-sectional view taken along the line A-A of FIG. 4. FIG. 6 is a plan view illustrating the patch antenna shown in FIG. 5.

The patch antenna according to the first embodiment includes: a patch 70 that has a through hole 70*a* through which a feeding line 96 passes to be connected to a feeding point (not shown); a ground plate 80 that has a through hole 80*a* formed therein and is spaced from the patch 70 by a predetermined gap; and a dielectric layer (or a dielectric substrate) 90 that has one or more holes 92 and 94 formed by punching and is provided between the patch 70 and the ground plate.

The patch 70 is a thin plate formed of a metallic material having high electric conductivity, such as copper, aluminum, gold, or silver.

The diameter of the through hole 80*a* formed in the ground plate 80 is larger than that of the feeding line 96 in order to prevent the through hole 80*a* from being electrically connected to the feeding line 96.

The dielectric layer 90 may be formed with a desired thickness by laminating a plurality of sheets (dielectric films). In the first embodiment, the dielectric layer 90 is formed of a single sheet having a predetermined thickness.

The dielectric layer 90 has a through hole 90*a* formed therein, through which a feeding line 96 for supplying power to the patch 70 passes. One end of the feeding line 96 is connected to the feeding point (not shown) of the patch 70. The other end of the feeding line 96 passes through the through hole 80*a* of the ground plate 80 to be electrically connected to a PCB (not shown).

The holes 92 and 94 are formed at the edge of the dielectric layer 90 (specifically, an outermost portion of the dielectric layer 90 facing the patch 70) by punching. In the first embodiment, a plurality of holes 92*a* to 92*n* (92) are vertically formed at the left side of the upper surface of the dielectric layer 90 by punching, and a plurality of holes 94*a* to 94*n* (94) are vertically formed at the right side of the upper surface of the dielectric layer 90 by punching.

In FIG. 3, the holes 92 and 94 are formed at the left and right sides of the upper surface of the dielectric layer 90, respectively, but the invention is not limited thereto. For example, the holes may be formed along the edge of the upper surface of the dielectric layer 90 (specifically, along an outermost portion of the dielectric layer 90 facing the patch 70). In this case, the holes 92 and 94 are formed in the dielectric layer 90 to have a predetermined depth.

A conductive material is applied on the inner surfaces of the holes 92 and 94 in order for electrical connection to the patch 70.

The holes 92 and 94 may be formed in various shapes, such as a circle, a triangle, a rectangle, and a pentagon, in plan view.

The diameter and number of holes 92 and 94 depend on a desired resonance frequency. That is, the resonance frequency can be changed according to the diameter, length, and number of holes 92 and 94. Therefore, the diameter and number of holes 92 and 94 can be changed according to a desired resonance frequency. As the number of holes 92 and 94 increases, the gap between the holes 92 and 94 is narrowed, or the diameter of the holes 92 and 94 increases, the size of the patch antenna becomes smaller. The holes 92 and 94 may be formed so as not to pass through the dielectric layer 90, that is, the holes 92 and 94 may be formed to have a predetermined depth. In this case, the larger the depth of the holes 92 and 94 becomes, the smaller the size of the patch antenna becomes.

Various methods may be used to manufacture the patch antenna having the above-mentioned structure according to the first embodiment. One of the methods will be described below.

First, a dielectric layer 90 having a relative dielectric constant of 7.5, a size of 25×25 mm, and a thickness of 4 mm is prepared.

Then, the holes 92 and 94 are formed at the edge of the dielectric layer 90 by using a puncher (for example, a puncher that is used in a process of manufacturing a PCB) (not shown) or a drill. In this case, the holes 92 and 94 may be formed so as to pass through the dielectric layer 90 or to have a predetermined depth (for example, a depth of 3.2 mm).

Subsequently, a conductive material is applied onto the inner surfaces of the holes 92 and 94.

Then, the patch 70 is provided on the upper surface of the dielectric layer 90 having the holes 92 and 94 formed therein, and the ground plate 80 is provided on the lower surface of the dielectric layer 90. When the patch 70 is provided on the upper surface of the dielectric layer 90 having the holes 92 and 94 formed therein, upper parts of the holes 92 and 94 come into contact with the edge of the lower surface of the patch 70.

Second Embodiment

Figure 7:
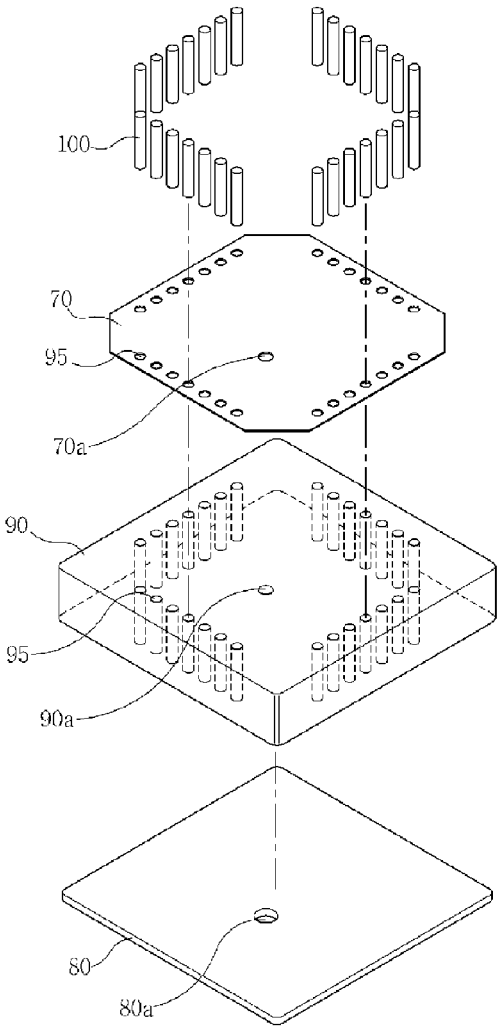
FIG. 7 is an exploded perspective view illustrating a patch antenna according to a second embodiment of the invention.

FIG. 7 is an exploded perspective view illustrating the structure of a patch antenna according to a second embodiment of the invention.

In the first embodiment, the holes 92 and 94 are formed at the edge of the dielectric layer 90, and a conductive material is applied onto the inner surfaces of the holes 92 and 94. However, in the second embodiment of the invention, holes 95 with a predetermined diameter are formed in the patch 70 and the dielectric layer 90, and metal pins 100 are inserted into the holes 95.

That is, as shown in FIG. 7, the holes 95 with a predetermined diameter are formed along the edge of the patch 70. In addition, the holes 95 having the same diameter as those formed in the patch 70 are formed at the edge of the dielectric layer 90 (that is, at positions corresponding to the holes formed in the patch 70).

In this case, the holes 95 formed in the dielectric layer 90 so as to pass through the dielectric layer 90 or to have a predetermined depth. In this embodiment, it is assumed that the holes 95 formed in the dielectric layer 90 have the same depth.

It is preferable to laminate the patch 70 on the dielectric layer 90 and then form the holes 95 in the laminated structure by using a general puncher, in order to reduce the manufacturing costs of a product (patch antenna).

Then, the metal pins 100 are inserted into the holes 95. Hollow metal pins 100 may be used. The metal pins 100 are connected to the patch 70 directly or by soldering.

Figure 8:
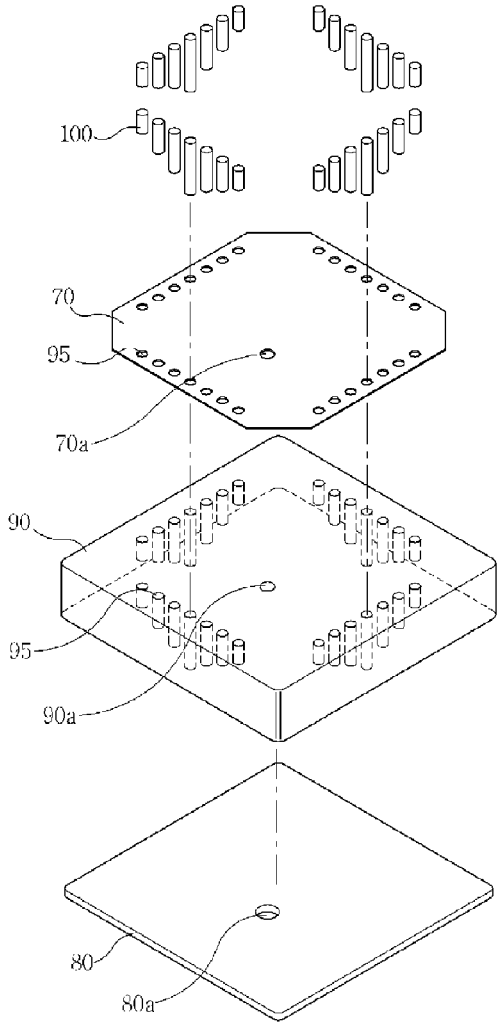
FIG. 8 is an exploded perspective view illustrating a modification of the patch antenna shown in FIG. 7.

FIG. 8 is an exploded perspective view illustrating a modification of the embodiment shown in FIG. 7. The modification shown in FIG. 8 differs from the embodiment shown in FIG. 7 in the depth of the hole 95 and the length of the metal pin 100.

That is, in the embodiment shown in FIG. 7, the holes 95 formed in the dielectric layer 90 have the same depth, but in the modification shown in FIG. 8, the holes 95 formed in the dielectric layer 90 have different depths. Therefore, the metal pins 100 also have different lengths.

As shown in FIG. 8, the dielectric layer 90 has a rectangular shape in plan view. Specifically, seven holes 95 are formed along each side of the dielectric layer 90. Among the seven holes 95, a center hole has the largest depth, and the depth of the holes decreases in the direction away from the center hole. When the holes 95 are formed to have different depths, lengths from a feeding portion to radiating members are different from each other, which makes it possible to form a circularly polarized wave. Of course, the holes 95 may be formed such that the outermost holes have the largest depth and the depth of the holes decreases in the direction of the center. The reason why the holes 95 are formed along each side of the dielectric layer 90 is that the intensity of an electric field is the highest at the edge of the dielectric layer 90. Therefore, it is possible to adjust a resonance frequency by deforming the edge of the dielectric layer 90. For example, the depth of the hole 95 can be adjusted in order to obtain a desired resonance frequency. Since the holes 95 have different depths, the metal pins 100 inserted into the holes 95 also have different lengths.

Particularly, in the structures shown in FIGS. 7 and 8, the metal pins 100 make it unnecessary to plate the inner surfaces of the holes 95 with gold. In other words, in the first embodiment, the inner surfaces of the holes are plated with gold, but in the second embodiment and the modification, the metal pins are used. Therefore, it is not necessary to coat the inner surfaces of the holes with a conductive material, resulting in achieving an inexpensive patch antenna easier than that of the first embodiment.

Various methods can be used to manufacture the patch antennas according to the second embodiment and the modification thereof. One of the methods will be described below.

First, a dielectric layer 90 having a relative dielectric constant of 7.5, a size of 25×25 mm, and a thickness of 4 mm is prepared.

Subsequently, the patch 70 is provided on the upper surface of the dielectric layer 90.

Then, a plurality of holes 95 are formed at the edge of a laminated structure of the dielectric layer 90 and the patch 70 by using a puncher (for example, a puncher that is used in a process of manufacturing a PCB) (not shown) or a drill. In this case, the holes 95 may be formed so as to pass through the dielectric layer 90 or to have a predetermined depth (for example, a depth of 3.2 mm). Alternatively, the holes 95 may be formed in the dielectric layer 90 to have different depths.

Subsequently, conductive materials, such as the metal pins 100, are inserted into the holes 95.

Finally, the ground plate 80 is provided on the lower surface of the dielectric layer 90.

Figure 9:
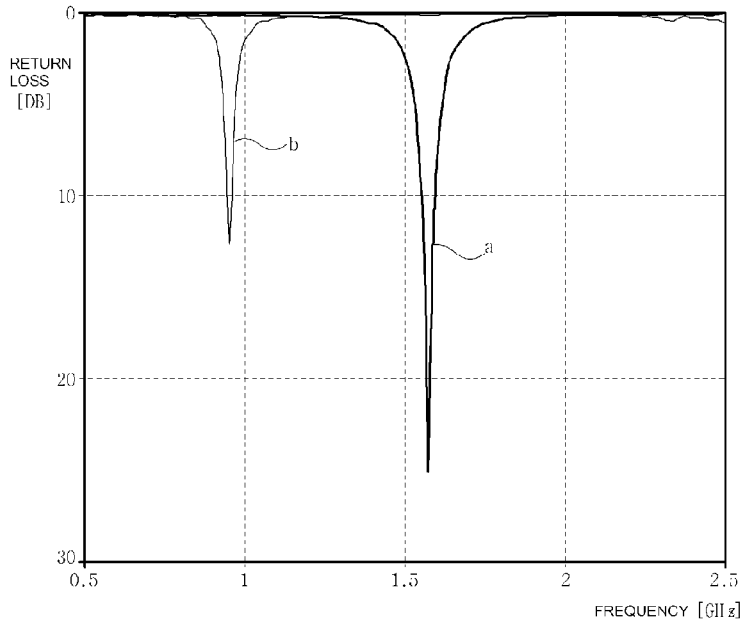
FIG. 9 is a graph illustrating that the patch antenna according to the first embodiment or the second embodiment of the invention can obtain the same return loss as the patch antenna according to the related art.

FIG. 9 is a graph illustrating that the patch antenna according to the first embodiment or the second embodiment of the invention can obtain the same return loss as the patch antenna according to the related art.

In FIG. 9, 'a' indicates the return loss of the existing GPS antenna (for example, a dielectric layer has a size of 25×25 mm, a thickness of 4 mm, and a relative dielectric constant of 20), and 'b' indicates the return loss of a GPS antenna using a conventional dielectric laminate and iris (for example, a dielectric layer has a size of 25×25 mm, a thickness of 4 mm, and a relative dielectric constant of 20).

As can be seen from FIG. 9, when the dielectric layers have the same size, width, and relative dielectric constant, the resonance frequency (b) of the GPS antenna using a conventional dielectric laminate and iris is moved from the resonance frequency (a) of the existing GPS antenna to a low-frequency side by about 500 MHz or more. This means that the effect of increasing the length of the antenna is obtained by the iris.

Therefore, the patch antenna according to the first embodiment or the second embodiment of the invention resonates in the resonance frequency band of the existing GPS antenna, but has a smaller size than that of the existing GPS antenna. For example, when the patch 70 has a size of 22×22 mm, the dielectric layer 90 has a size of 25×25×4 mm and a relative dielectric constant of 7.5, and seven holes 92 and seven holes 94, each having a depth of 3.2 mm, are formed in the dielectric layer 90, the patch antenna according to the first embodiment resonates in the resonance frequency band of the existing GPS antenna.

That is, the resonance frequency of the patch antenna depends on the length and number of holes 92 and 94 formed in the dielectric layer 90. Therefore, even when a dielectric material (a low dielectric material) having a low relative dielectric constant is used, it is possible to obtain the same radiation characteristic and electrical characteristic as a dielectric material (a high dielectric material) having a high relative dielectric constant, which makes it possible to prevent a reduction in yield and an increase in the manufacturing costs.

Third Embodiment

Figure 10:
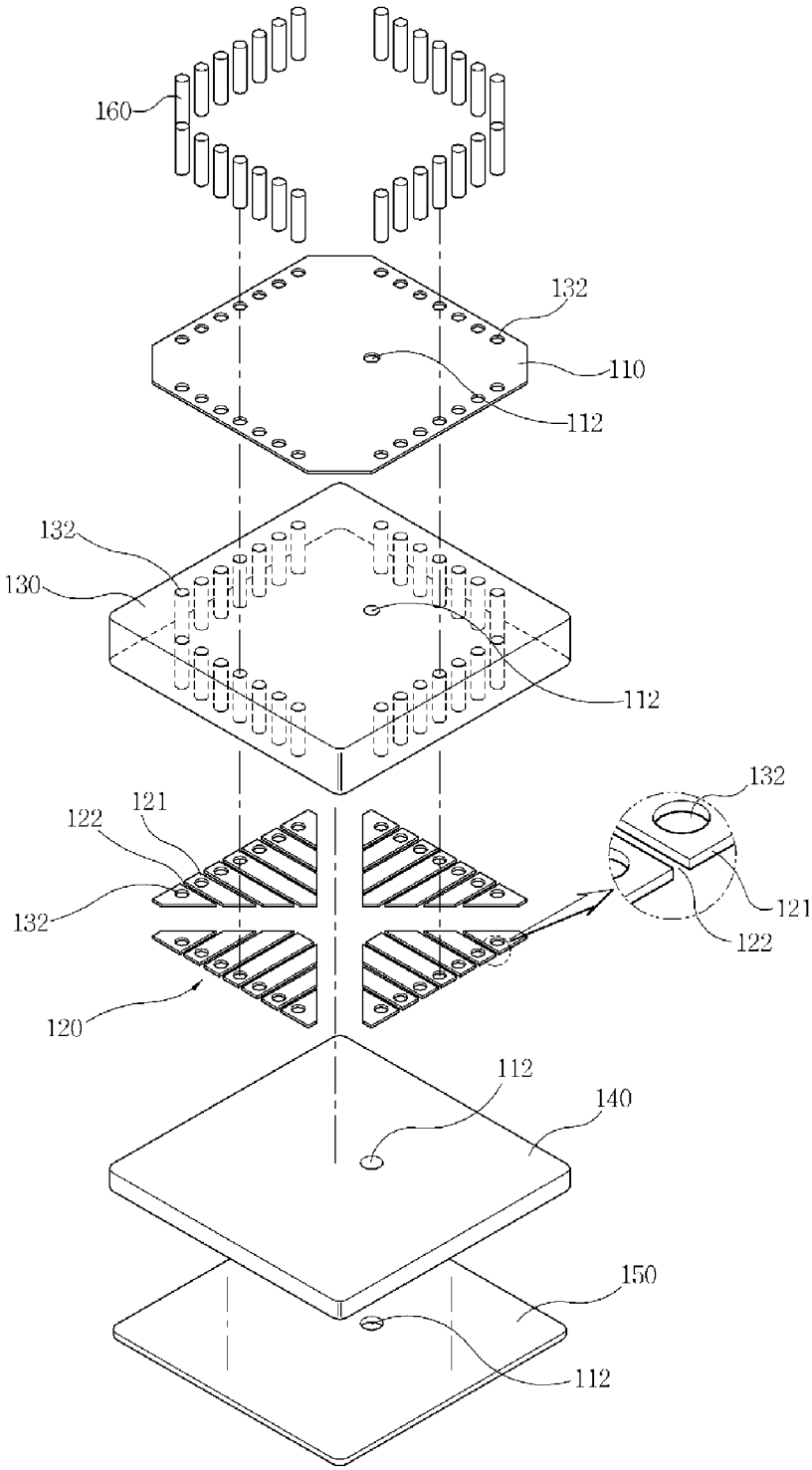
FIG. 10 is an exploded perspective view illustrating a patch antenna according to a third embodiment of the invention.
Figure 11:
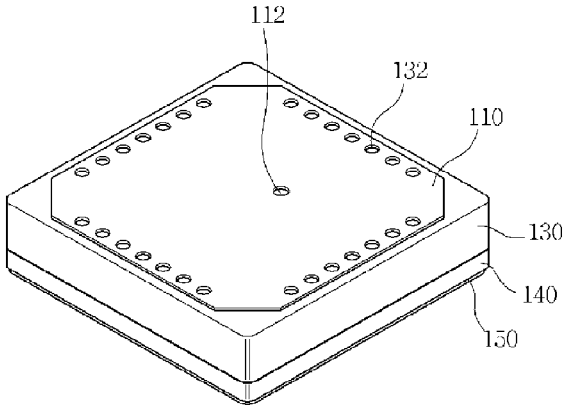
FIG. 11 is a perspective view illustrating the assembled patch antenna shown in FIG. 10.
Figure 12:
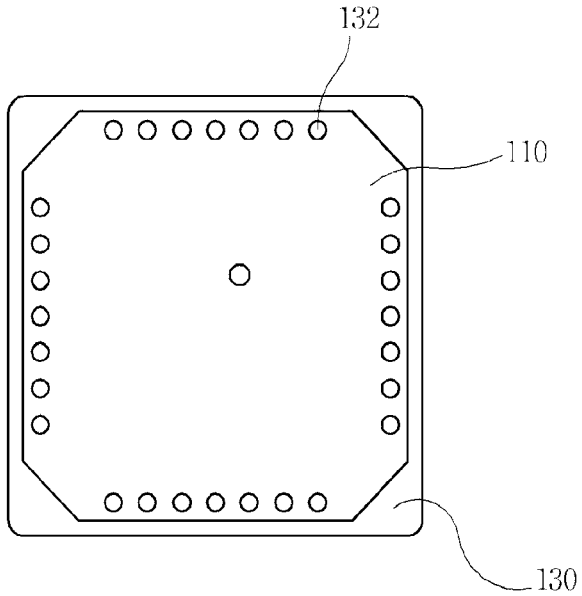
FIG. 12(*a*) is a top view illustrating a first dielectric layer shown in FIG. 11, and FIG. 12(*b*) is a bottom view illustrating the first dielectric layer shown in FIG. 11.
Figure 12:
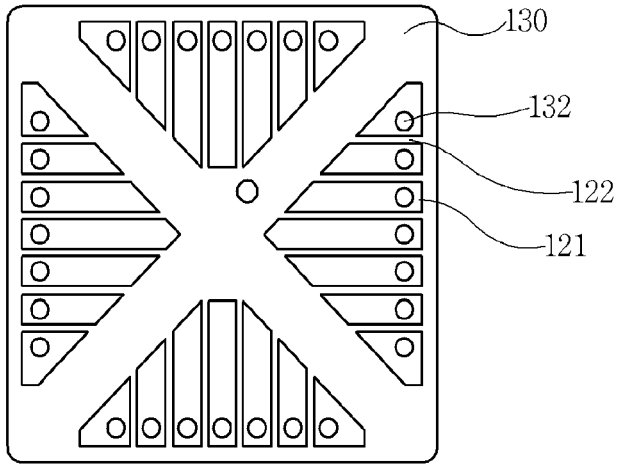

FIG. 10 is an exploded perspective view illustrating a patch antenna according to a third embodiment of the invention. FIG. 11 is a perspective view illustrating the assembled patch antenna shown in FIG. 10. FIG. 12(*a*) is a top view illustrating a first dielectric layer shown in FIG. 11, and FIG. 12(*b*) is a bottom view illustrating the first dielectric layer shown in FIG. 11.

A patch antenna according to the third embodiment includes an upper patch 110, a lower patch 120, a first dielectric layer 130, a second dielectric layer 140, and a ground plate 150.

The upper patch 110 is formed of a thin plate made of a metallic material having high electric conductivity, such as copper, aluminum, gold, or silver, and has a through hole 112 formed therein. A feeding line (not shown) passes through the through hole 112 to be connected to a feeding point (not shown). In addition, holes 132 with a predetermined diameter are formed at the edge of the upper patch 110 (for example, along four sides).

The lower patch 120 is formed of a thin plate that is made of the same material as that forming the upper patch 110. The lower patch 120 includes a plurality of patch groups (four patch groups in FIG. 11), and each of the patch groups is divided into a plurality of patch pieces by a plurality of slots 122. The plurality of patch groups of the lower patch 120 are separated from each other. In FIG. 10, the patch groups opposite to each other are formed so as to be aligned symmetrically, but the invention is not limited thereto. The patch groups may be asymmetrically formed. Holes 132 with predetermined diameters are formed at the outermost side of each of the patch groups of the lower patch 120 (that is, the outermost sides of the patch pieces 121).

As the gap between the slots 122 becomes narrow, the capacitance formed therebetween becomes larger, which results in a low resonance frequency characteristic.

The first dielectric layer 130 is provided between the upper patch 110 and the lower patch 120. Holes 132 with predetermined diameters are vertically formed at the edge of the first dielectric layer 130 (for example, at positions corresponding to the holes 132 formed in the upper patch 110 and the lower patch 120). The holes 132 may be formed so as to pass through the first dielectric 130 or to have a predetermined depth.

The holes 132 are formed at the same positions in the upper patch 110, the lower patch 120, and the first dielectric layer 130. In addition, conductive materials, such as metal pins 160, are inserted into the holes 132 in order to electrically connect the upper patch 110 and the lower patch 120. Hollow metal pins 160 may be used.

That is, in the structure shown in FIG. 10, the metal pins 160 are used to electrically connect the upper patch 110 and the lower patch 120, but the invention is not limited thereto. The upper patch 110 and the lower patch 120 may be electrically connected to each other without using the metal pins 160. For example, a conductive material may be applied into the holes 132 to connect the upper patch 110 and the lower patch 120, which will be understood by those skilled in the art even though the additional drawings related to this structure are not provided. In the third embodiment, it is more preferable to form holes and apply a conductive material into the holes than to additionally provide the metal pins 160, in order to reduce the number of manufacturing processes.

Figure 13:
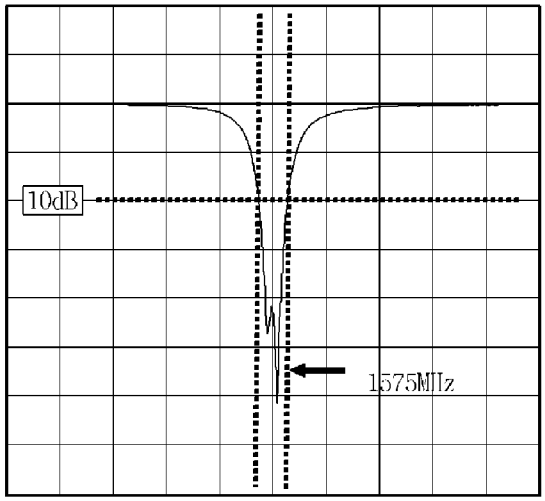
FIG. 13 is graphs illustrating the comparison between the bandwidth of the patch antenna according to the related art and the bandwidth of the patch antenna according to the third embodiment of the invention. Specifically, FIG. 13(*a*) is a graph illustrating the bandwidth of the patch antenna according to the related art, and FIG. 13(*b*) is a graph illustrating the bandwidth of the patch antenna according to the third embodiment of the invention.
Figure 13:
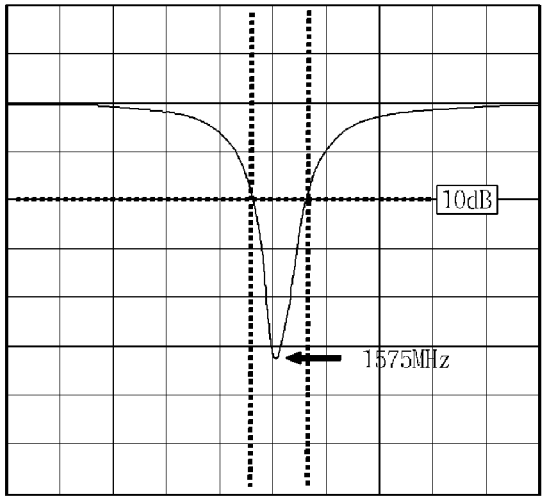

When the first dielectric layer 130 is interposed between the upper patch 110 and the lower patch 120, the patch antenna has physically the same patch area as the existing folded patch antenna (Korean Patent No. 10-0562788). However, the patch antenna according to this embodiment has a broadband characteristic caused by the coupling between the patch pieces 121 separated by the slots 122 formed on the lower patch 120. Therefore, as shown in FIG. 13, the patch antenna according to the third embodiment of the invention (see FIG. 13(*b*)) has a bandwidth of 40 MHz that is wider than the bandwidth of 20 MHz of the folded patch antenna (see FIG. 13(*a*)).

Figure 14:
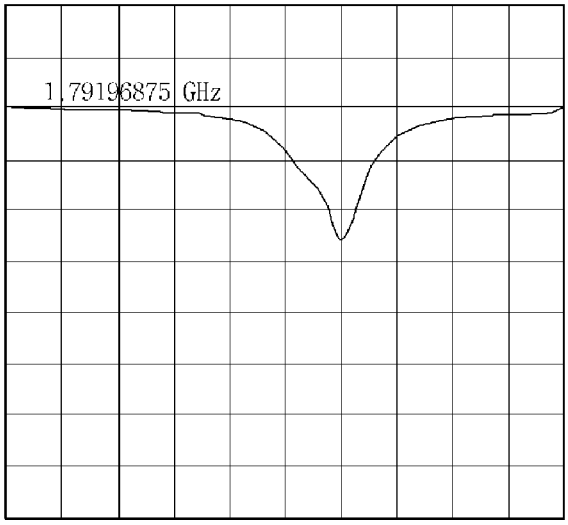
FIG. 14 is graphs illustrating the comparison between the return loss of a folded patch antenna according to the related art and the return loss of the patch antenna according to the third embodiment of the invention. Specifically, FIG. 14(*a*) is a graph illustrating the return loss of the folded patch antenna according to the related art, and FIG. 14(*b*) is a graph illustrating the return loss of the folded patch antenna according to the third embodiment of the invention.
Figure 14:
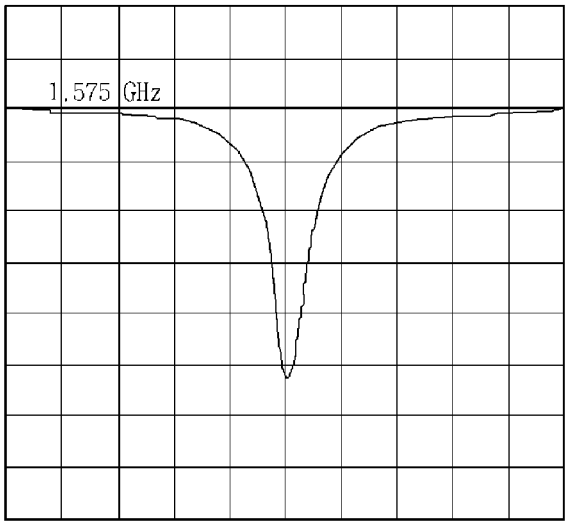

As can be seen from FIG. 14, the resonance frequency (1.79196875 GHz; see FIG. 14(*a*)) of the folded patch antenna differs from the resonance frequency (1.575 GHz; see FIG. 14(*b*)) of the patch antenna according to the third embodiment. Therefore, the patch size of the existing folded patch antenna needs to be larger than that of the patch antenna according to the third embodiment, in order to make the existing folded patch antenna to have a resonance frequency of 1.575 GHz.

Meanwhile, in FIG. 10, the thickness of the second dielectric layer 140 is less than that of the first dielectric layer 130. For example, when the first dielectric layer 130 has a thickness of 3.2 mm, the second dielectric layer 140 has a thickness of about 0.8 mm. A through hole 112 is formed in the second dielectric layer 140. In the patch antenna having a constant thickness, the thicker the upper dielectric layer becomes, the lower the resonance frequency becomes. Therefore, in the third embodiment, the thickness of the first dielectric layer 130, which is an upper layer, is larger than that of the second dielectric layer 140, which is a lower layer, in order to reduce the size of the patch antenna.

In third embodiment, the second dielectric layer 140 has a higher relative dielectric constant than the first dielectric layer 130. Alternatively, the first dielectric layer 130 and the second dielectric layer 140 may have the same relative dielectric constant. However, it is more preferable that the first dielectric layer 130 and the second dielectric layer 140 have different relative dielectric constants. The reason is to further reduce the size of the patch antenna. That is, it is possible to obtain the effect of electrically increasing the physical length of the lower patch 120 by increasing the relative dielectric constant of the second dielectric layer 140. As a result, it is possible to further reduce the size of the patch antenna. In addition, this structure can obtain higher gain characteristics than the structure according to the related art that increases the relative dielectric constant to reduce the size of the antenna.

The sum of the thicknesses of the first dielectric layer 130 and the second dielectric layer 140 is equal to the thickness of the existing patch antenna.

A through hole 112 having a larger diameter than that of a feeding line (not shown) is formed in the ground plate 150. The feeding line (not shown) passes through the through hole 112 to be connected to a feeding point (not shown) of the upper patch 110. One end of the feeding line (not shown) is connected to the feeding point (not shown) of the upper patch 110, and the other end of the feeding line (not shown) passes through the through hole 112 of the ground plate 150 to be electrically connected to a PCB (not shown).

Figure 15:
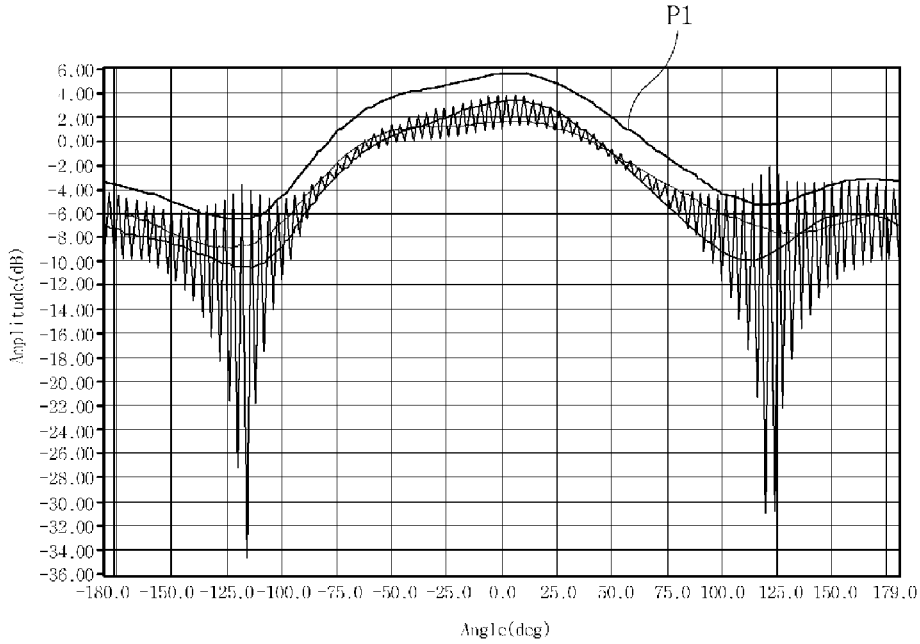
FIG. 15 is graphs illustrating the comparison between the gain characteristic of the patch antenna according to the related art and the gain characteristic of the patch antenna according to the third embodiment of the invention. Specifically, FIG. 15(*a*) is a graph illustrating the gain characteristic of the patch antenna according to the related art, and FIG. 15(*b*) is a graph illustrating the gain characteristic of the patch antenna according to the third embodiment of the invention.
Figure 15:
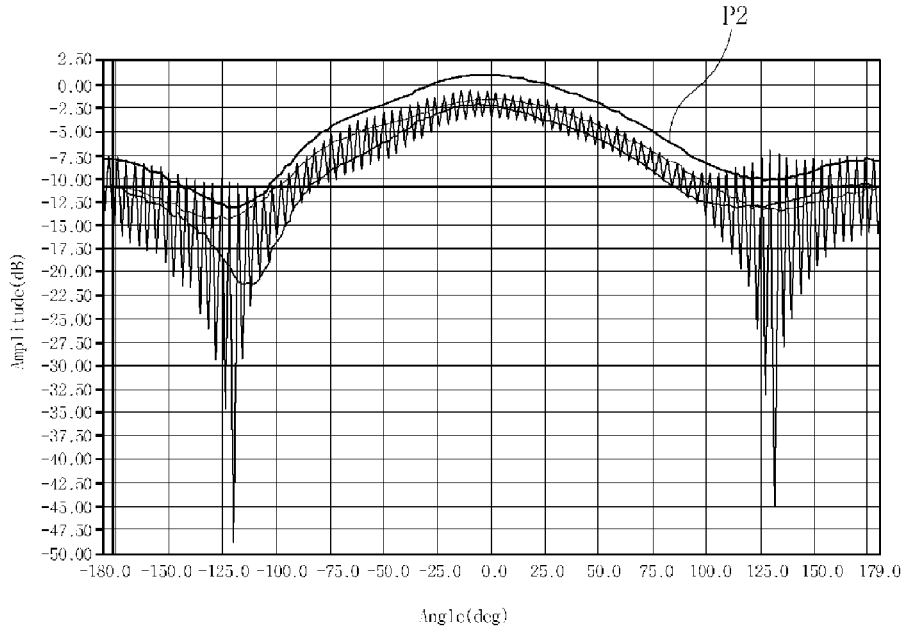
Figure 16:
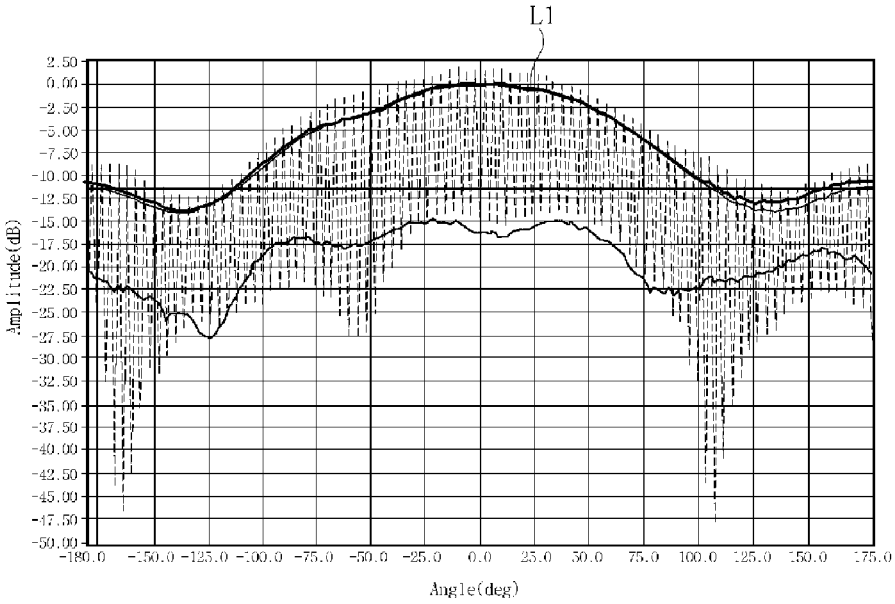
FIG. 16 is graphs illustrating the comparison between the gain characteristic of the folded patch antenna according to the related art and the gain characteristic of the patch antenna according to the third embodiment of the invention. Specifically, FIG. 16(*a*) is a graph illustrating the gain characteristic of the folded patch antenna according to the related art, and FIG. 16(*b*) is a graph illustrating the gain characteristic of the patch antenna according to the third embodiment of the invention.
Figure 16:
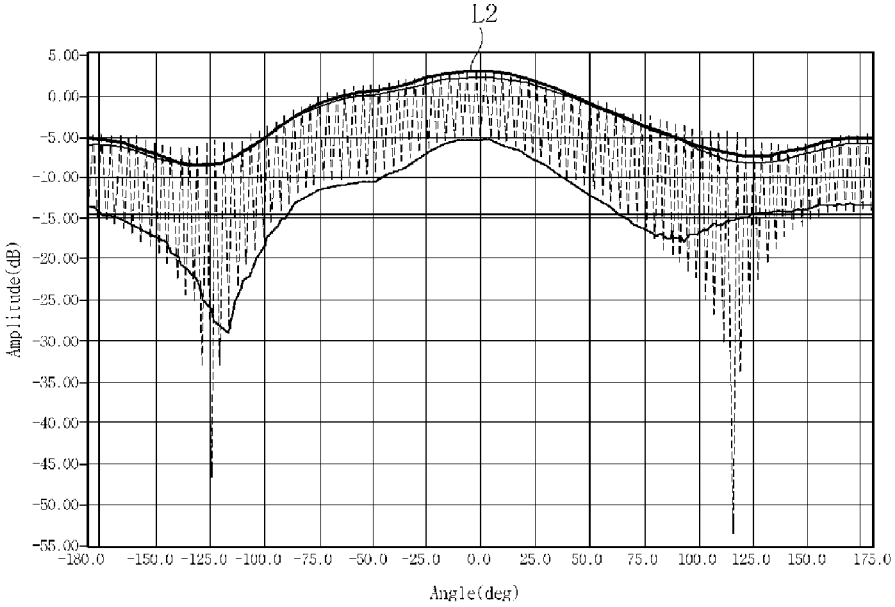

FIG. 15 is graphs illustrating the comparison between the gain characteristic of the patch antenna according to the third embodiment and the gain characteristic of the existing patch antenna. As can be seen from FIG. 15, the gain characteristic (see FIG. 15(*b*)) of the patch antenna according to the third embodiment is a little lower than that (see FIG. 15(*a*)) of the existing patch antenna. However, as can be seen from FIG. 16 illustrating the comparison between the gain characteristic of the patch antenna according to the third embodiment and the gain characteristic of the existing folded patch antenna, the gain characteristic (see FIG. 16(*a*)) of the existing folded patch antenna is −0.09 dBi, and the gain characteristic (see FIG. 16(*b*)) of the patch antenna according to the third embodiment is 2.97 dBi. The difference between the gain characteristics is about 3 dBi. Therefore, the patch antenna according to the third embodiment can improve radiation characteristics, as compared to the existing folded patch antenna.

Fourth Embodiment

Figure 17:
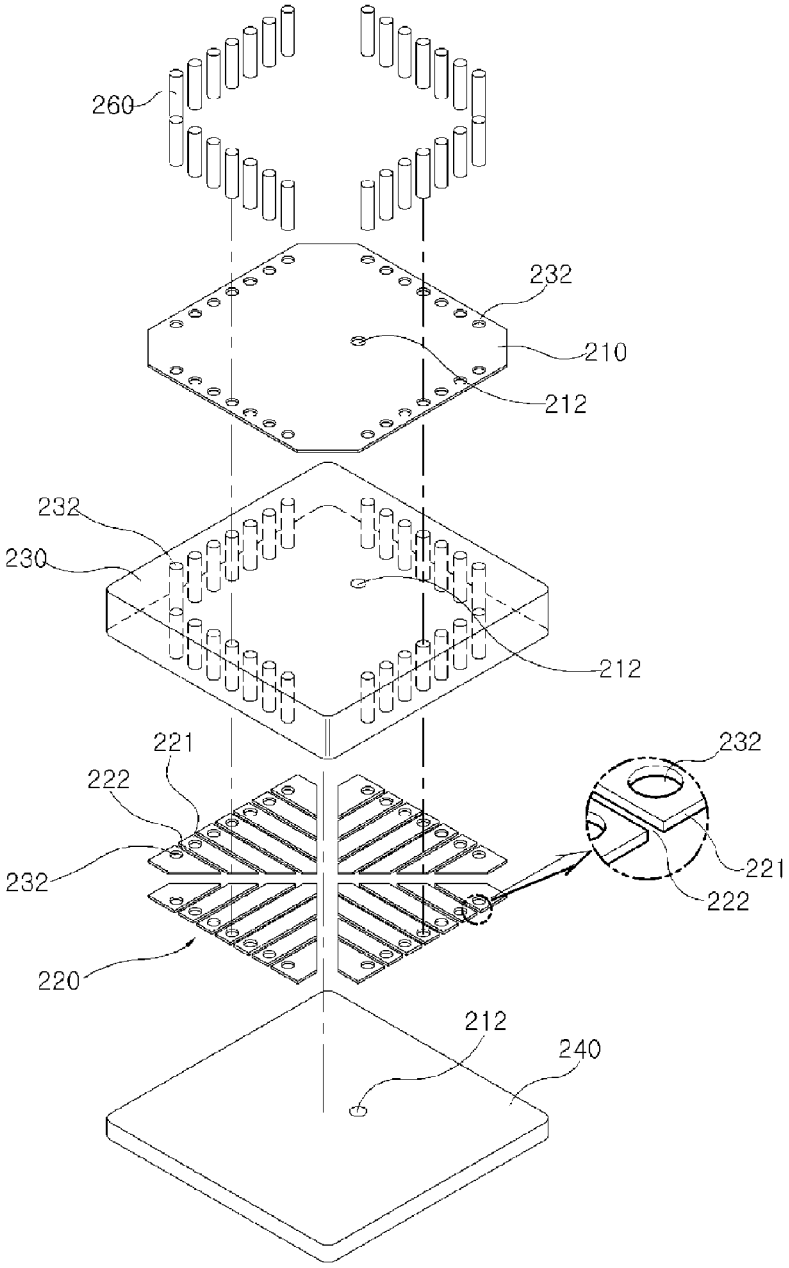
FIG. 17 is an exploded perspective view illustrating a patch antenna according to a fourth embodiment of the invention.
Figure 18:
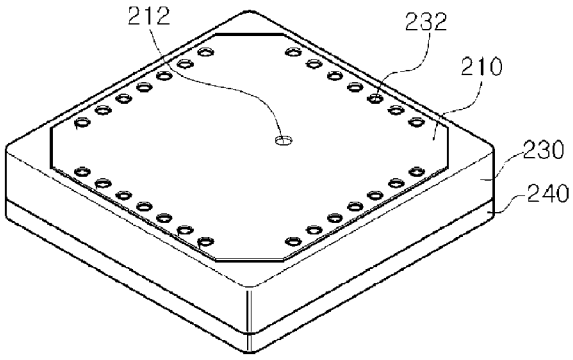
FIG. 18 is a perspective view illustrating the assembled patch antenna shown in FIG. 17.
Figure 19:
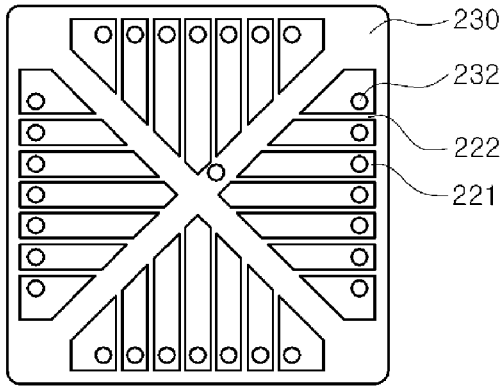
FIG. 19 is a bottom view illustrating a first dielectric layer shown in FIG. 18.

FIG. 17 is an exploded perspective view illustrating a patch antenna according to a fourth embodiment of the invention. FIG. 18 is a perspective view illustrating the assembled patch antenna shown in FIG. 17. FIG. 19 is a bottom view illustrating a first dielectric layer shown in FIG. 17.

The patch antenna according to the fourth embodiment includes an upper patch 210, a lower patch 220, a first dielectric layer 230, and a second dielectric layer 240.

The upper patch 210, the first dielectric layer 230, and the second dielectric layer 240 according to the fourth embodiment have the same structure and function as the upper patch 110, the first dielectric layer 130, and the second dielectric layer 140 according to the third embodiment. Therefore, a detailed description of the upper patch 210, the first dielectric layer 230, and the second dielectric layer 240 will be omitted, which will be understood by those skilled in the art.

Next, only the difference in structure and function between the patch antenna according to the third embodiment and the patch antenna according to the fourth embodiment will be described below.

Patch antennas having a high radiation gain and a small size have been demanded, and many antenna manufacturers have made efforts to meet the demands.

In general, when the ground plate is removed from the patch antenna, the radiation gain of the patch antenna is improved. Therefore, it is preferable to remove the ground plate from the patch antenna in order to improve antenna characteristics. However, when the ground plate is removed, the resonance frequency band of the patch antenna increases. Therefore, it is necessary to increase the size of the patch antenna in order to obtain a desired resonance frequency. That is, in the related art, it is necessary to increase the size of the patch antenna, that is, the patch size, thereby lowering the resonance frequency, in order to achieve a patch antenna having a high radiation gain.

However, the fourth embodiment of the invention can provide a patch antenna having a desired resonance frequency and a high radiation gain by changing the structure and shape of the lower patch 200, without increasing the size of the patch antenna.

The lower patch 220 is formed on a lower surface of the first dielectric layer 230. The lower patch 220 is formed of a thin plate that is made of the same material as that forming the upper patch 210. The lower patch 220 includes a plurality of patch groups (four patch groups in FIG. 19), and each of the patch groups is divided into a plurality of patch pieces 221 by a plurality of slots 222. The plurality of patch groups of the lower patch 220 are separated from each other. As the gap between the slots 222 and the gap between the patch groups of the lower patch 220 become narrow, the capacitance formed therebetween becomes larger, which results in a low resonance frequency. Therefore, in the patch antenna according to the fourth embodiment of the invention, the gap between the slots 222 and the gap between the patch groups of the lower patch 220 are narrower than those in the patch antenna according to the third embodiment, thereby increasing the capacitance formed therebetween. This means that it is possible to make the patch antenna resonate at a lower frequency without increasing the size of the patch antenna. Therefore, the fourth embodiment of the invention can provide a patch antenna having a high radiation gain and a desired resonance frequency.

In FIG. 19, the patch groups opposite to each other are formed so as to be aligned symmetrically, but the invention is not limited thereto. The patch groups may be asymmetrically formed. In addition, the shape of the lower patch 220 is not limited to that shown in FIG. 19, but the lower patch 220 may be formed in various shapes that can be considered by those skilled in the art from the specification.

Holes 232 with predetermined diameter are formed at the outermost side of each of the patch groups of the lower patch 220 (that is, the outermost sides of the patch pieces 221).

Meanwhile, in a patch antenna having a high dielectric layer (for example, having a relative dielectric constant of 20 or more), when the ground plate is not formed, it is difficult to accurately measure the resonance frequency during a manufacturing process. In the patch antenna having the high dielectric layer, the resonance frequency depends on the ground resistance of the patch antenna. That is, when the ground plate is not provided in the patch antenna, it is difficult to completely connect the patch antenna to the ground surface by using a jig. When the patch antenna is not completely grounded, it is difficult to accurately measure the resonance frequency due to the characteristics of the high dielectric layer. Therefore, in the patch antenna having the dielectric layer (high dielectric layer) having a high dielectric constant, the ground plate is generally formed on the lower surface of the dielectric layer.

However, the patch antenna according to the fourth embodiment of the invention has dielectric layers 230 and 240 having a low dielectric constant (for example, a relative dielectric constant of 5). In the patch antenna having low dielectric layers, the resonance frequency is kept constant, regardless of the ground resistance of the patch antenna. Therefore, even when the patch antenna is not completely grounded, it is possible to accurately measure the resonance frequency during the manufacturing process. For this reason, in the patch antenna having low dielectric layers according to the fourth embodiment of the invention, the ground plate is not formed on the lower surface of the dielectric layer.

It will be apparent to those skilled in the art that various modifications and changes may be made without departing from the scope and spirit of the present invention. Therefore, it should be understood that the above embodiments are not limitative, but illustrative in all aspects. The scope of the present invention is defined by the appended claims rather than by the description preceding them, and therefore all changes and modifications that fall within metes and bounds of the claims, or equivalents of such metes and bounds are therefore intended to be embraced by the claims.

The invention claimed is:

1. A patch antenna comprising:

an upper patch;

a lower patch that is divided into a plurality of patch groups each having a plurality of patch pieces that are separated by a plurality of slots;

a first dielectric layer that is provided between the upper patch and the lower patch, wherein the upper patch which is a plate and the plurality of patch pieces of the lower patch are electrically connected by holes passing through the first dielectric layer;

a second dielectric layer that is provided on a lower surface of the lower patch;

a ground plate that is provided on a lower surface of the second dielectric layer and is insulated from the lower patch;

a through hole that passes through the upper patch, the first dielectric layer, the second dielectric layer and the ground plate; and a feeding line that passes through the through hole, one end of the feeding line is connected to a feeding point of the upper patch, wherein the plurality of patch groups are separated from each other, each of the patch groups being formed in a triangle shape, wherein a resonance frequency of the patch antenna is adjustable through an adjustment of a gap between the plurality of slots, wherein the thickness of the first dielectric layer is larger than that of the second dielectric layer, and wherein the second dielectric layer has a higher relative dielectric constant than that of the first dielectric layer.

2. The patch antenna of claim 1, wherein the holes are formed at the edge of the first dielectric layer so as to pass through the first dielectric layer.

3. The patch antenna of claim 1, wherein conductive materials are inserted into the holes.

4. The patch antenna of claim 1, wherein a conductive material is applied onto the inner surface of each of the holes.

5. The patch antenna of claim 1, wherein the plurality of patch groups of the lower patch are formed such that the patch groups opposite to each other are aligned symmetrically.

* * * * *

UNITED STATES PATENT AND TRADEMARK OFFICE

CERTIFICATE OF CORRECTION

PATENT NO. : 8,587,480 B2
APPLICATION NO. : 12/440842
DATED : November 19, 2013
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 752 days.

Signed and Sealed this
Twenty-second Day of September, 2015

Michelle K. Lee

Michelle K. Lee
*Director of the United States Patent and Trademark Office*